US008729984B2

(12) United States Patent
Feller et al.

(10) Patent No.: US 8,729,984 B2
(45) Date of Patent: May 20, 2014

(54) MAGNETIC ACTUATOR WITH MORE THAN ONE AIR GAP IN SERIES

(75) Inventors: Willy Feller, Rombach (CH); Beat Villiger, Reinach (CH)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 53 days.

(21) Appl. No.: 13/153,573

(22) Filed: Jun. 6, 2011

(65) Prior Publication Data

US 2012/0306600 A1 Dec. 6, 2012

(51) Int. Cl.

| | |
|---|---|
| ***H01H 67/02*** | (2006.01) |
| ***H01H 9/00*** | (2006.01) |
| ***H01F 7/18*** | (2006.01) |

(52) U.S. Cl.

USPC ..... 335/119; 335/35; 335/164; 335/172; 335/173; 335/174; 335/185; 335/131; 335/124; 335/184; 335/203; 335/232; 335/242; 335/249; 335/279

(58) Field of Classification Search

USPC ..... 335/9–10, 21, 35, 77, 164–166, 335/172–174, 185, 195, 131, 119, 124, 184, 335/203, 232, 242, 249, 279

See application file for complete search history.

(56) References Cited

U.S. PATENT DOCUMENTS

| | | | | |
|---|---|---|---|---|
| 1,331,086 | A * | 2/1920 | Atwood | 335/166 |
| 2,278,971 | A * | 4/1942 | Boehne | 335/157 |
| 2,653,201 | A * | 9/1953 | Wallace | 335/33 |
| 3,569,879 | A | 3/1971 | Gryctko | |
| 4,491,812 | A * | 1/1985 | Happach | 335/184 |
| 4,546,955 | A * | 10/1985 | Beyer et al. | 251/129.15 |
| 4,808,952 | A * | 2/1989 | Berner et al. | 335/41 |
| 4,825,180 | A * | 4/1989 | Miyaji | 335/131 |
| 4,931,758 | A * | 6/1990 | Bagalini | 335/174 |
| 5,453,724 | A * | 9/1995 | Seymour et al. | 335/172 |
| 5,563,563 | A * | 10/1996 | Freitas et al. | 335/126 |
| 6,693,503 | B1 * | 2/2004 | Nguyen et al. | 335/131 |
| 7,199,687 | B2 * | 4/2007 | Maruhashi et al. | 335/131 |
| 7,639,108 | B2 * | 12/2009 | Miyake | 335/126 |
| 8,125,303 | B2 * | 2/2012 | Klingel et al. | 335/126 |
| 8,305,168 | B2 * | 11/2012 | Cotič et al. | 335/126 |
| 2003/0053274 | A1 | 3/2003 | Raabe et al. | |
| 2010/0188176 | A1 | 7/2010 | Faik et al. | |
| 2010/0327202 | A1 * | 12/2010 | Birkelund | 251/129.15 |
| 2010/0332046 | A1 | 12/2010 | Liberto et al. | |

* cited by examiner

*Primary Examiner* — Mohamad Musleh

(74) *Attorney, Agent, or Firm* — Quarles & Brady LLP

(57) ABSTRACT

Systems and methods provide a magnetic actuator having more than one air gap. After the trip unit is triggered, a first armature is accelerated to quickly close a first air gap and then mate with a second armature. The first and second armature then move toward a core to close a second air gap and reach the final combined armature position, causing a contact to open. A faster reaction time is provided, yet without increasing the number of turns of the trip coil winding, and provides a more efficient actuator.

16 Claims, 9 Drawing Sheets

MAGNETIC ACTUATOR WITH MORE THAN ONE AIR GAP IN SERIES

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The subject matter disclosed herein relates generally to magnetic actuators, and, more particularly, to magnetic actuator configurations including more than one air gap.

Devices such as circuit breakers, accessories for circuit breakers, and relays, for example, include a trip unit that, when a predetermined level of current is sensed, opens the current path to stop the flow of the current through an electrical circuit. Circuit breakers are well-known and commonly used to provide this automatic circuit interruption when undesired overcurrent conditions occur. Overcurrent conditions can include, but are not limited to, overload conditions, ground faults, and short-circuit conditions. The ability to break the flow of current is usually achieved by having a movable contact(s), which is attached to a movable arm or blade, that separates from a stationary contact(s), which is attached to a stationary arm or blade. The trip unit includes a magnetic actuator, which is the component that drives the tripping action using, in general, a spring-biased mechanism to force the movable blade, and therefore the movable contact, away from the stationary contact.

In general, the magnetic actuator component of the trip unit is designed to react as quick as possible, yet magnetic actuators with one air gap, however, start slowly due to their initial mass and large initial airgap and therefore generate low forces during the initial portion of the travel. Attempts have been made to improve the reaction time, but these improvements have come with unwanted costs. For example, a higher number of turns of a trip coil winding would increase the force acting on the magnetic actuator allowing for a faster reaction time, but with the higher number of turns of the coil winding comes an unwanted and unacceptable increase of power loss from the circuit breaker, thereby causing inefficiency and an increase in overall size.

It would, therefore, be desirable to have magnetic actuators that provide improved reaction times, but without the drawbacks that comes along with known magnetic actuators.

BRIEF DESCRIPTION OF THE INVENTION

The present embodiments overcome the aforementioned problems with providing a faster reaction time of the magnetic actuator by providing systems and methods including a magnetic actuator having more than one air gap. After the trip unit is triggered, a first armature is accelerated to quickly close a first air gap and then mate with a second armature. The first and second armature then move toward a core to close a second air gap and reach the final combined armature position, causing the contact to open. This novel solution provides a faster reaction time, yet without increasing the number of turns of the trip coil winding, and provides a more efficient solution.

Accordingly, embodiments of the present invention include a magnetic actuator for opening a contact to interrupt the flow of current. The actuator comprises a first armature and a second armature, the first armature and the second armature spaced apart by a first qap while in a reset position. The second armature and a core are spaced apart by a second gap while in the reset position.

To the accomplishment of the foregoing and related ends, the embodiments, then, comprise the features hereinafter fully described. The following description and the annexed drawings set forth in detail certain illustrative aspects of the invention. However, these aspects are indicative of but a few of the various ways in which the principles of the invention can be employed. Other aspects, advantages and novel features of the invention will become apparent from the following detailed description of the invention when considered in conjunction with the drawings.

BRIEF DESCRIPTION OF THE DRAWINGS

The embodiments will hereafter be described with reference to the accompanying drawings, wherein like reference numerals denote like elements, and.

DETAILED DESCRIPTION OF THE INVENTION

Figure 1:
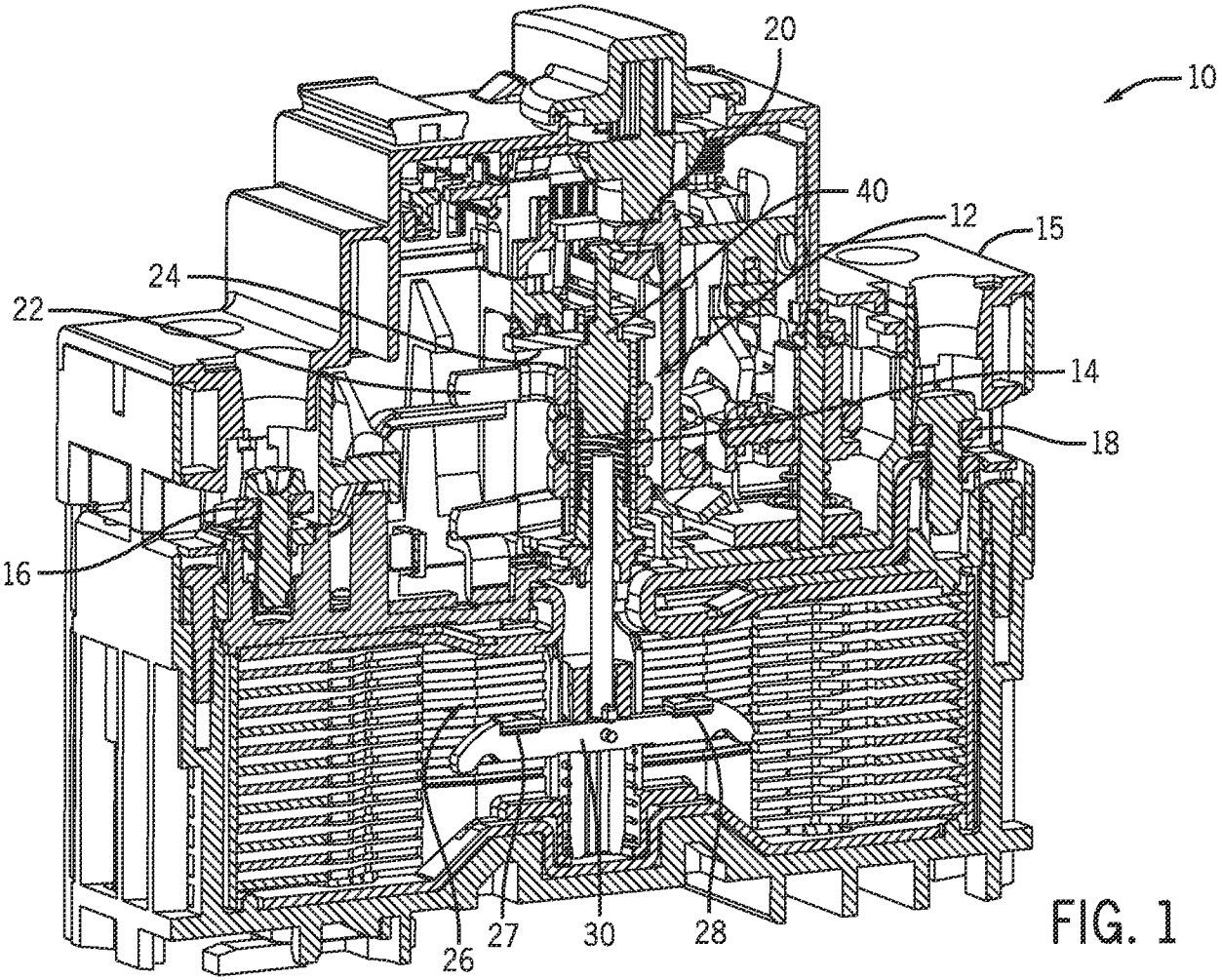
FIG. 1 is a perspective view in section of an exemplary circuit breaker including a single gap magnetic actuator.

Turning now to the drawings, and referring initially to FIG. 1, an exemplary circuit breaker 10 containing a magnetic actuator 12 with a single gap 14 positioned within a housing 15 is shown. The circuit breaker 10 includes a line wire input 16 for electrically connecting a current carrying input wire (not shown) to the input of the circuit breaker, and a line wire output 18 for electrically connecting a current carrying output wire (not shown) to the output of the circuit breaker. The current carrying wires and the circuit breaker 10 comprise a portion of an electrical circuit. Once the input and output wires are electrically connected to the circuit breaker 10, and the trip mechanism 20 is reset, current is able to flow through the circuit breaker 10. The current flows from the line wire input 16 to the trip coil 22. The trip coil 22 includes n number of turns around a coil former 24, where n is a predetermined number depending on the circuit breaker configuration. The single gap magnetic actuator 12 is shown generally within the coil former 24. Current flows through the trip coil and to a contact 26. In one embodiment, the circuit breaker includes a first contact 27 and second contact 28. A movable contact arm 30 electrically couples the first contact 27 to the second contact 28. When the first and second contacts are closed, current is able to flow through the movable contact arm 30 and to the line wire output 18.

Figure 2:
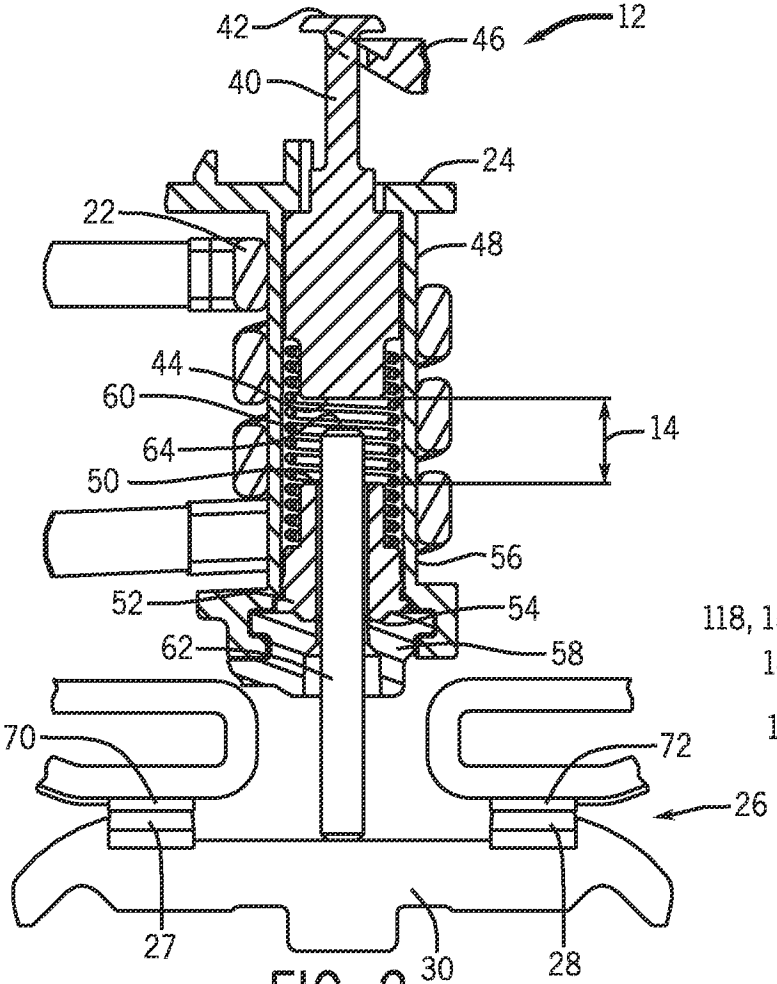
FIG. 2 is a side view in section of the single gap magnetic actuator shown in FIG. 1.

As seen in FIGS. 1 and 2, the magnetic actuator 12 is shown with a single gap 14 between the pole faces of an armature 40 and a core 52. Referring particularly to FIG. 2, the armature 40 includes a first end 42 and a second end 44, the second end being a generally flat pole face. The first end 42 releasably couples to the trip mechanism 46. The armature 40 is partially housed within an upper portion 48 of the coil former 24. As previously discussed, the trip coil 22 winds around the coil former 24. The traditional magnetic actuator 12 includes only this one gap 14 between the second end 44 of the armature 40 and the first end 50 of the core 52. The first end 50 being a mating generally flat pole face.

The core 52 includes the first end 50 and a second end 54, and is positioned near a lower portion 56 of the coil former 24, and may be retained in the coil former 24 with a termination cover 58 at or near the lower portion 56 of the coil former. A spring 60 provides an expansion force between the armature 40 and the core 52. A non-magnetic push rod 62 slidably extends through the core 52.

In use, the armature 40 is the component of the magnetic actuator 12 that moves when a magnetic field generated by current flow through the trip coil 22 exceeds the expansive force of the spring 60. The magnetic field causes the armature 40 to move in the direction of the core 52. During the movement of the armature 40 toward the core 52, the second end 44 of the armature 40 contacts the first end 64 of the push rod 62. The second end 66 of the push rod 62 is mechanically coupled to the movable contact arm 30.

The gap 14 is sized to allow a predetermined amount of downward travel of the armature 40 before the second end 44 of the armature 40 contacts the first end 64 of the push rod 62 before the pole faces mate. The size of gap 14 determines the extent of travel of the armature 40. As the armature 40 overcomes the initial force of the spring 60 and travels towards the core 52 due to the magnetic force, the second end 44 of the armature 40 contacts the first end 64 of the push rod 62. The armature 40 continues to travel toward the core 52, thereby pushing the push rod 62 downward, which in turn causes the movable contact arm 30 to separate from the fixed portions 70 and 72 of contacts 27 and 28 respectively, and open the contacts 27 and 28, thereby breaking the flow of current through the circuit breaker 10. The gap 14 is closed when the second end 44 of the armature 40 contacts the first end 50 of the core 52.

Referring now to FIGS. 3, 4, 5, and 6, trip units according to embodiments of the invention are shown. As can be seen in each of the embodiments, the armature may be separated into at least two individual armature components, although it is to be appreciated that more than two armature components are contemplated as part of the invention. A first actuator gap 102 is provided between a first armature 104 and a second armature 106, and a second actuator gap 108 is provided between the second armature 106 and the stationary core 110. Each of the embodiments shown in FIGS. 3, 4, 5, and 6 will now be described in greater detail. Where applicable, like elements will bear like reference numerals.

Figure 3:
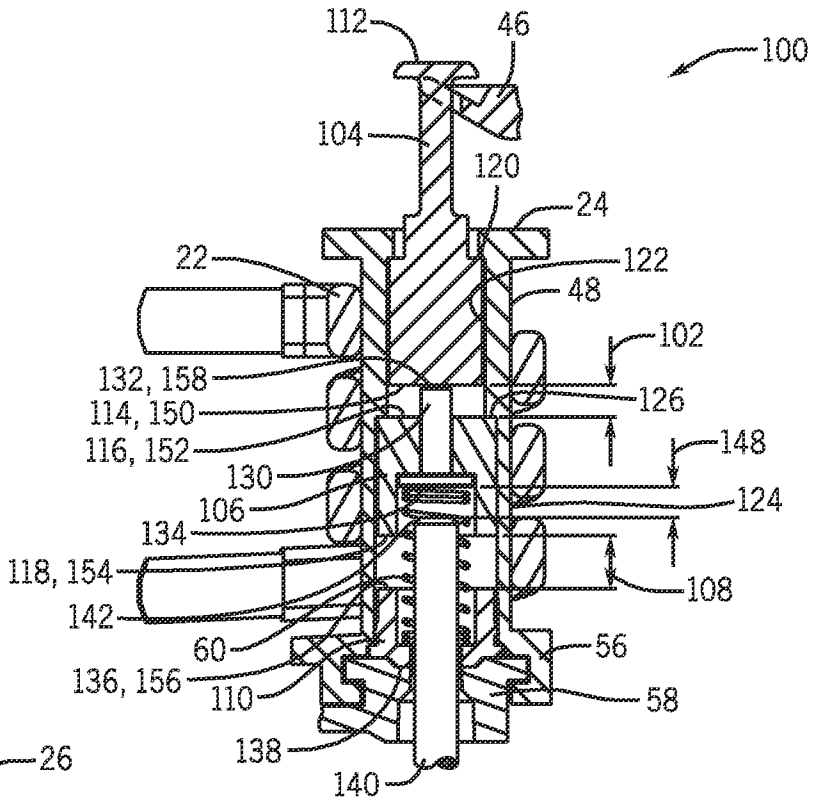
FIG. 3 is a side view in section of a magnetic actuator according to embodiments of the invention, and including more than one actuator gap.

Referring to FIG. 3, a novel magnetic actuator 100 is shown including a first actuator gap 102 and a second actuator gap 108. The magnetic actuator 100 includes a first armature 104 a second armature 106, both with generally flat pole faces. The first armature 104 includes a first end 112 and a second end 114, and the second armature 106 includes a first end 116 and a second end 118. The first end 112 of the first armature 104 releasably couples to the trip mechanism 46. The first armature 104 may be partially housed within the upper portion 48 of the coil former 24, and in one embodiment is retained from sliding upward from within the coil former by a lip or rim 120 on the inner wall 122 of the coil former. As with the traditional magnetic actuator 12, the trip coil 22 winds around the coil former 24. The novel magnetic actuator 100 includes the first actuator gap 102 between the second end 114 of the first armature 104 and the first end 116 of the second armature 106.

The second armature 106 is housed within the mid section 124 of the coil former 24, and, in one embodiment may also be restrained from sliding upward from within the coil former by a second lip or rim 126 on the inner wall 122 of the coil former. A non-magnetic transmission plunger 130 having a first end 132 and a second end 134 slidably extends through the second armature 106, with the second end 134 contacting a spring 60. The spring 60 provides an expansion force between the second end 134 of the transmission plunger 130 and the core 110. The core 110 includes a first end 136 and a second end 138 and is positioned near the lower portion 56 of the coil former 24 and may be retained in the coil former 24, such as with a termination cover 58 at or near the lower portion 56 of the coil former. A non-magnetic push rod 140 having a first end 142 and a second end 144 extends through the core 110, with the second end 144 of the push rod 140 being mechanically coupled to the movable contact arm 30 (see FIG. 7). A plunger gap 148 may be positioned between the second end 134 of the transmission plunger 130 and the first end 142 of the push rod 140.

The first actuator gap 102 and the second actuator gap 108 may be equal in spacing, or one gap may be larger than the other. In a preferred embodiment, the first actuator gap 102 spacing is smaller than the second actuator gap 108 spacing, such that the first actuator gap 102 closes before the second actuator gap 108 closes. The first actuator gap 102 may be sized to allow a predetermined amount of travel of the first armature 104 and the transmission plunger 130 toward the core 110 before the second end 134 of the transmission plunger 130 contacts the first end 142 of the push rod 140. After the second end 134 of the transmission plunger 130 contacts the first end 142 of the push rod 140, the first armature 104 continues to travel until the first actuator gap 102 closes, such that the second end 114 of the first armature 104 contacts the first end 116 of the second armature 106.

The first armature 104 and the second armature 106, along with the transmission plunger 130, continue to travel toward the core 110 until the second armature gap 108 closes, whereby the second end 118 of the second armature 106 contacts the first end 136 of the core 110.

As seen in FIG. 3, in some embodiments, the second end 114 of the first armature 104 comprises a generally flat surface or pole face 150. The first end 116 of the second armature 106 may also comprise a generally flat mating surface or pole face 152, such that when the first gap 102 closes, surface 150 mates with surface 152 for maximum surface contact.

Similarly, in some embodiments, the second end 118 of the second armature 106 comprises a generally flat surface or pole face 154. The first end 136 of the core may also comprise a generally flat mating surface or pole face 156, such that when the second actuator gap 108 closes, surface 154 mates with surface 156 for maximum surface contact.

Figure 5:
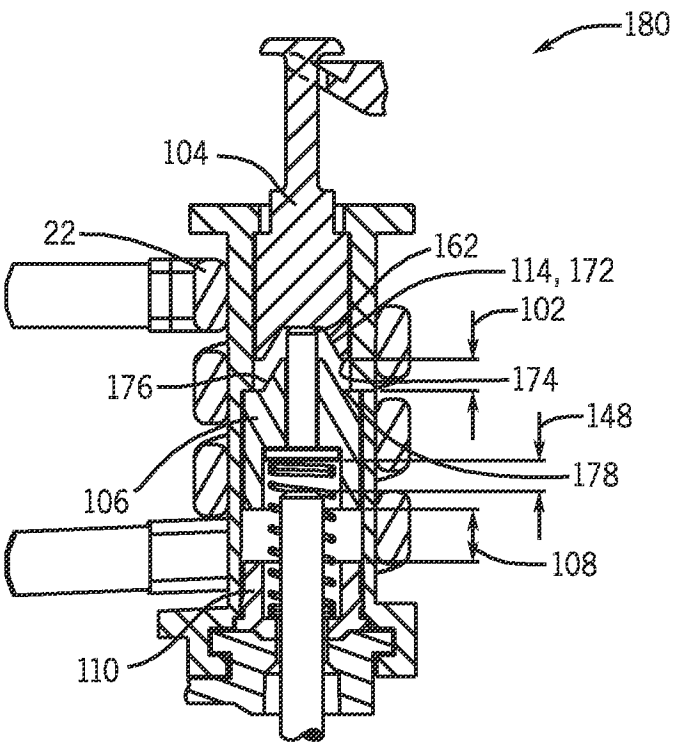
FIG. 5 is a side view in section of another alternative magnetic actuator according to embodiments of the invention, and including more than one actuator gap.

In some embodiments, the first end 132 of the transmission plunger 130 comprises a generally flat surface 158, and in other embodiments, the first end may comprise a more rounded surface 160 (see FIG. 4), and in yet other embodiments, the first end may comprise a generally flat surface with a chamfered edge 162 (see FIG. 5). It is to be appreciated that the both the first end 132 and the second end 134 of the transmission plunger 130 may comprise a variety of other shapes and/or other configurations, and are contemplated as part of the invention.

Figure 4:
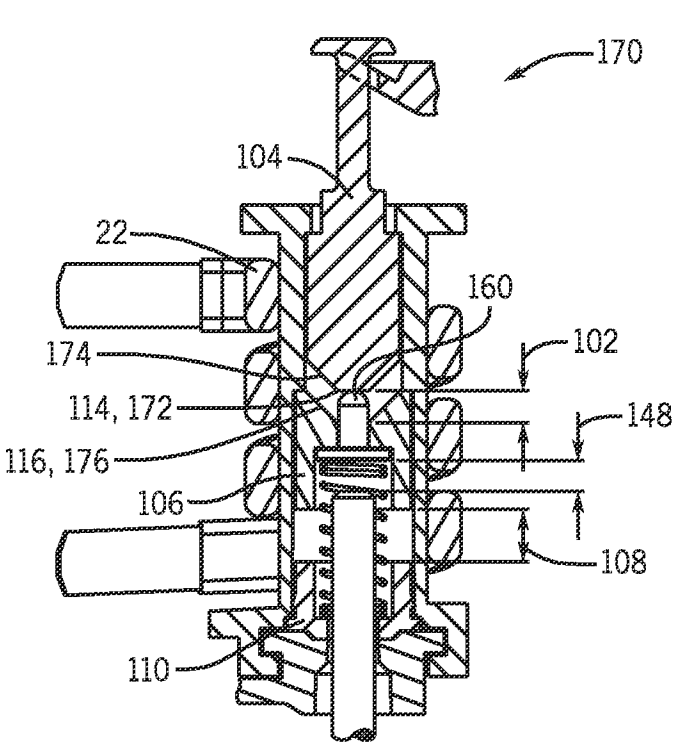
FIG. 4 is a side view in section of an alternative magnetic actuator according to embodiments of the invention, and including more than one actuator gap.

Referring to FIG. 4, an alternative embodiment of the novel magnetic actuator 170 is shown. In this embodiment, the second end 114 of the first armature 104 comprises a generally flat surface 172 with a chamfered edge 174, generally appearing as an inverted frustoconical shaped pole face. The first end 116 of the second armature 106 comprises a generally mating inverted frustoconical shaped surface or pole face 176, such that when the first actuator gap 102 closes, the second end surface 174 mates with surface 176 for maximum surface contact.

Referring to FIG. 5, an additional alternative embodiment of the novel magnetic actuator 180 is shown. In this embodiment, the second end 114 of the first armature 104 comprises a generally frustoconical surface or pole face 172, and may include a generally flat surface 174 at the edges of the frustoconical surface. The first end 116 of the second armature 106 comprises a generally mating frustoconical surface or pole face 176, and may include a mating generally flat surface 178 at the edges, such that when the first actuator gap 102 closes, surfaces 172 and 174 mate with surfaces 176 and 178 for maximum surface contact.

Figure 6:
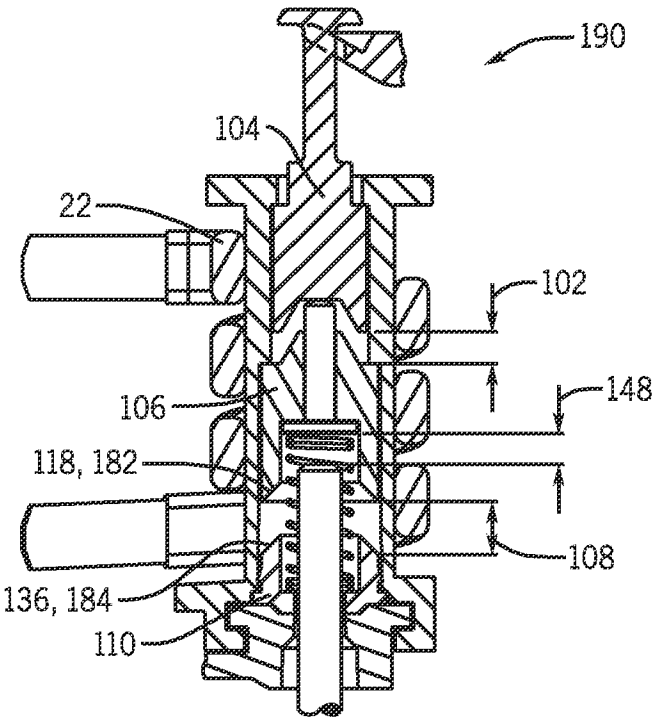
FIG. 6 is a side view in section of yet another alternative magnetic actuator according to embodiments of the invention, and including more than one actuator gap.

Referring to FIG. 6, yet an additional alternative embodiment of the novel magnetic actuator 190 is shown. In this embodiment, the second end 118 of the second armature 106 comprises a generally inverted frustoconical surface or pole face 182. The first end 136 of the core 110 comprises a generally mating frustoconical surface or pole face 184, such that when the second actuator gap 108 closes, surface 182 mates with surface 184 for maximum surface contact. The pole faces of the first actuator gap 102 are shown to be similar or the same as the pole faces of gap 102 in FIG. 5. It is to be appreciated that a variety of other pole face shaped and combinations of shapes for the first actuator gap 102 and the second actuator gap 108 are contemplated as part of the invention.

Figure 7:
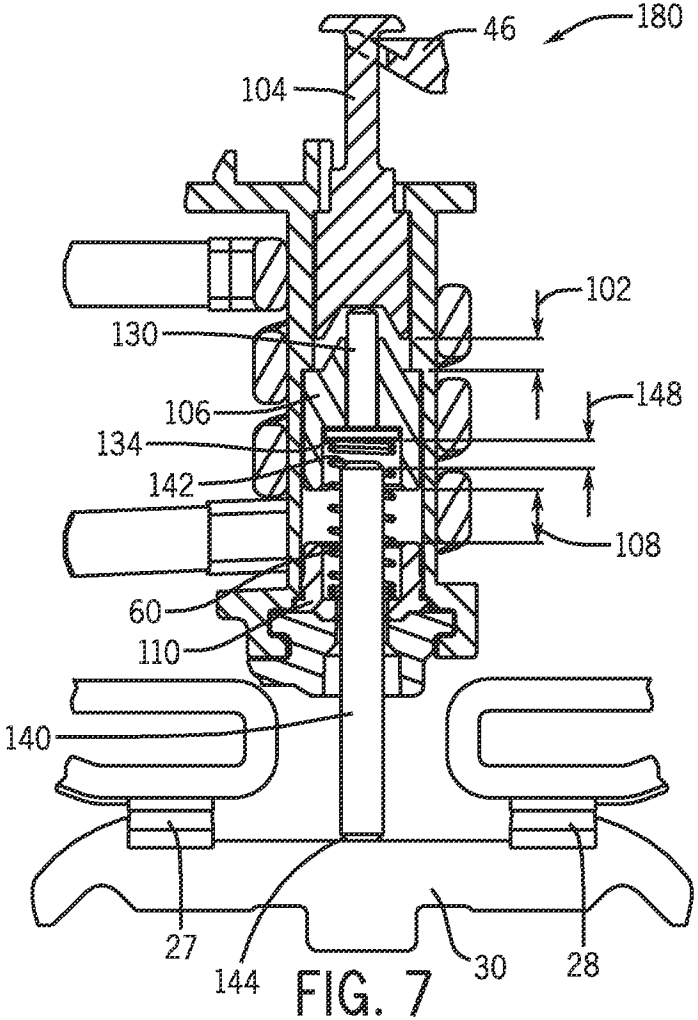
FIGS. 7 through 10 show the magnetic actuator of FIG. 5, showing actuator positions from reset to contacts open.
Figure 13:
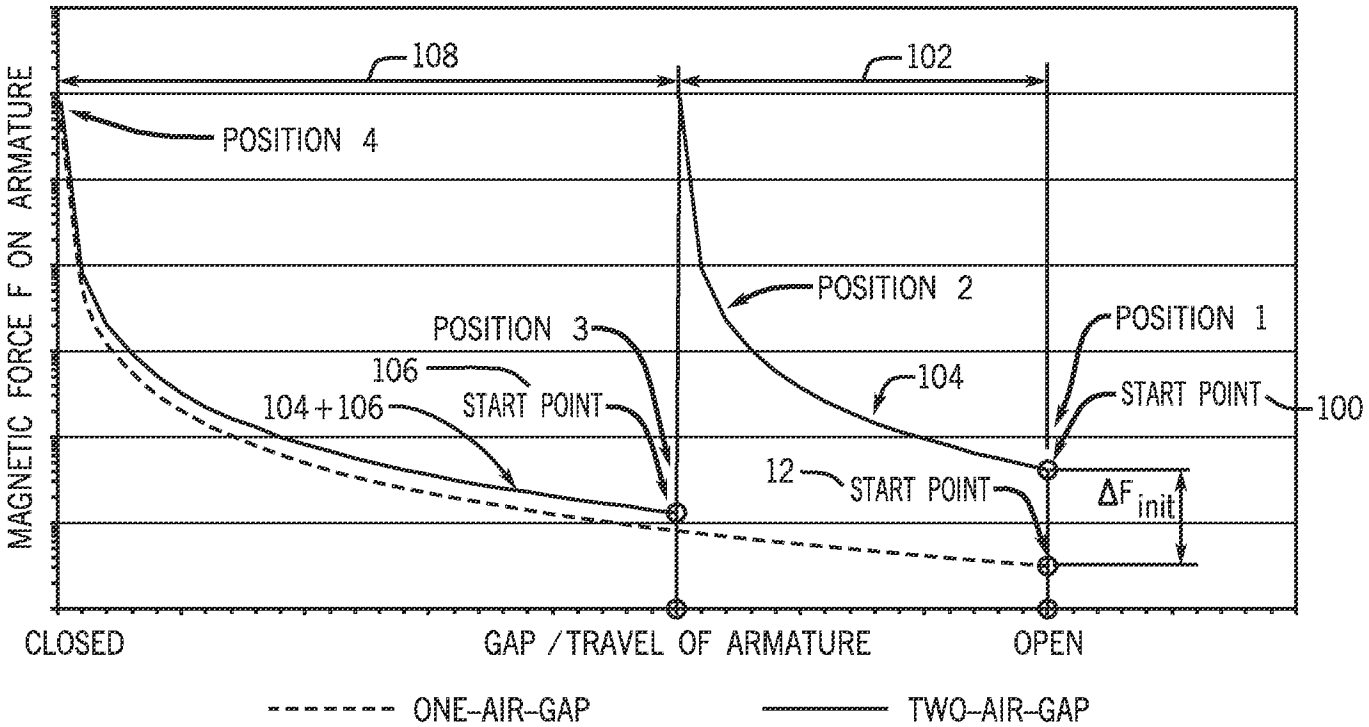
FIG. 13 is a graphical comparison of the magnetic force F for a given current between a single gap actuator and a two gap actuator.

Referring now to FIGS. 7 through 10 and FIG. 13, a magnetic actuator according to an embodiment of the invention will be described in use. FIGS. 7 and 13 show position one where the magnetic actuator 180 is in a reset position. In the reset position, current is allowed to flow through the closed contacts 27 and 28 and through the circuit breaker 10. In the reset position, the spacing of the first actuator gap 102 is greater than zero, and the spacing of the second actuator gap is also greater than zero. The plunger gap 148 between the second end 134 of the plunger 130 and the first end 142 of the push rod 140 is also greater than zero. The spring 60 is under compression and is applying an expansion force against the transmission plunger 130 and the core 110.

Figure 8:
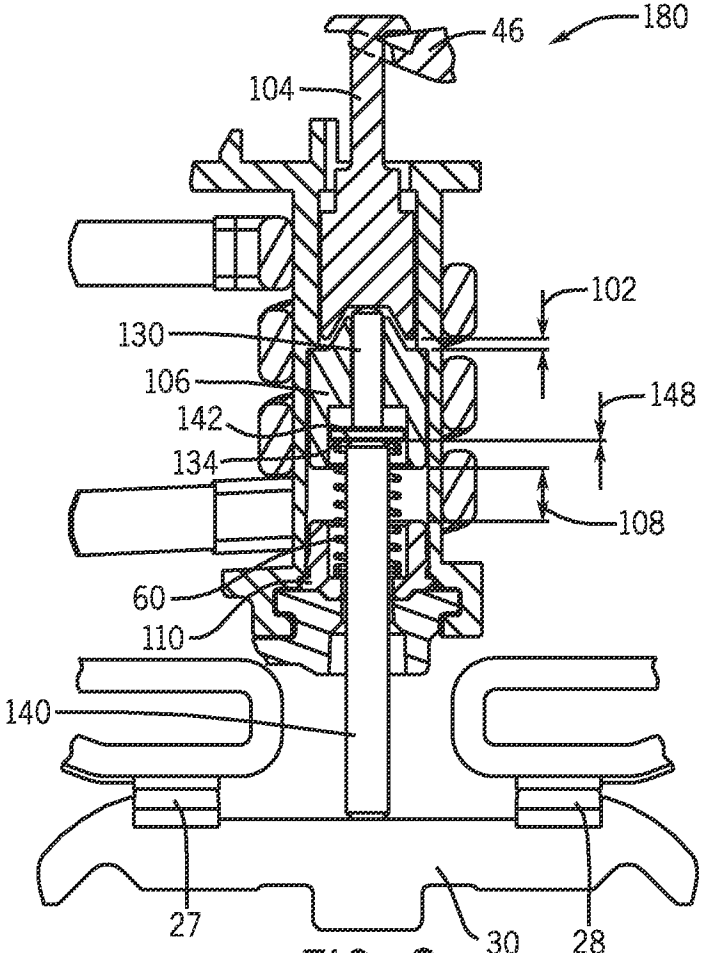

Referring to FIGS. 8 and 13 showing position two, when an undesired overcurrent condition occurs, the trip mechanism 46 is triggered. The first armature 104 travels toward the core 110, and in turn pushes the transmission plunger 130 toward the push rod 140. In one embodiment, the second end 134 of the plunger contacts the first end 142 of the push rod 140 causing the plunger gap 148 to become zero before the first actuator gap 102 reaches zero. Contacts 27 and 28 may still be closed but with the continued pressure applied by the first armature 104, the contacts 27 and 28 may start to open.

Figure 9:
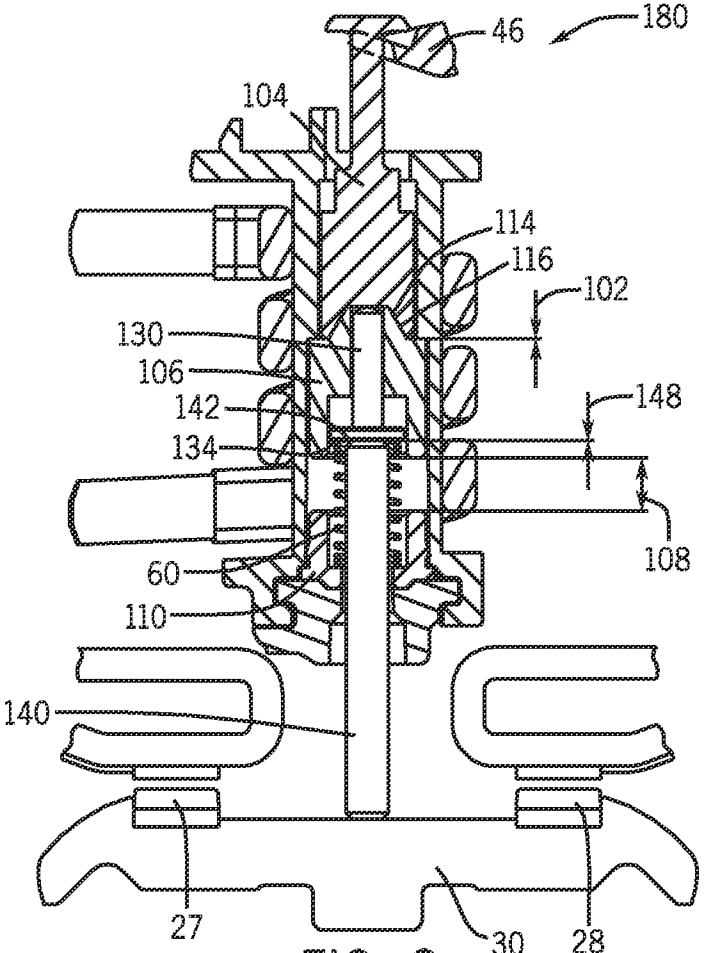

Referring to FIGS. 9 and 13 showing position three, the first armature 104 continues to travel, causing the first actuator gap 102 to reduce to zero, where the second end 114 of the first armature 104 mates with the first end 116 of the second armature 106. At this stage, in one embodiment, the first actuator gap 102 equals zero, the plunger gap 148 equals zero, and the second actuator gap 108 is greater than zero. Contacts 27 and 28 start to open.

Figure 10:
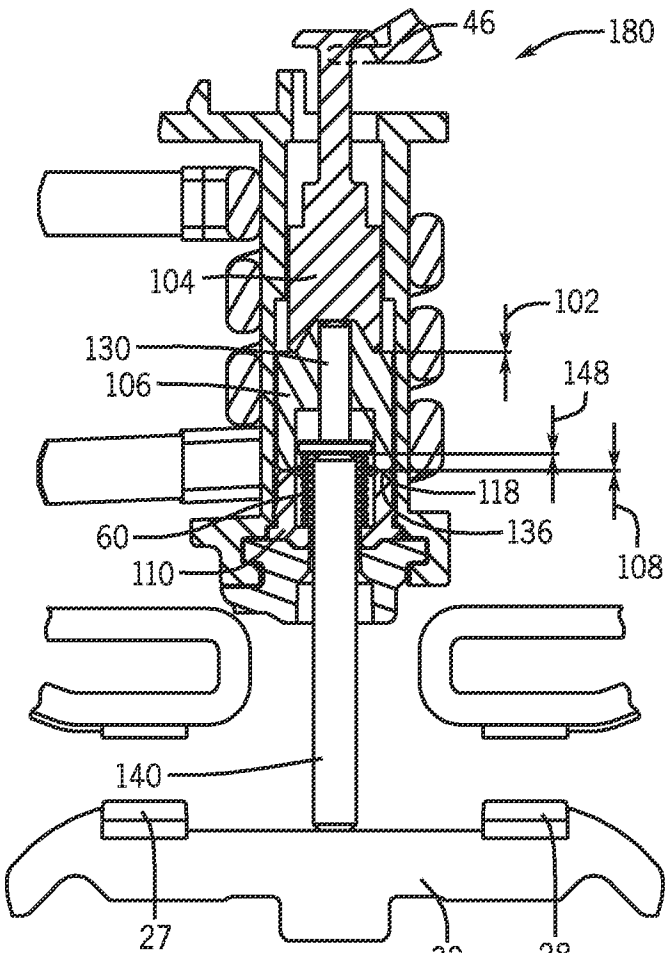

Referring to FIGS. 10 and 13, in position four, the first armature 104 and the second armature 106 together travel toward the core 110 until the second actuator gap 108 is reduced to zero, where the second end 118 of the second armature 106 mates with the first end 136 of the core 110. The force applied by the first armature 104 and the second armature 106, via the plunger 130 on the push rod 140, causes contacts 27 and 28 to open. Current is no longer able to flow through the contacts 27 and 28 and through the circuit breaker 10. It is to be appreciated that the descriptions of positions one, two, three, and four are for explanation purposes only.

Figure 11:
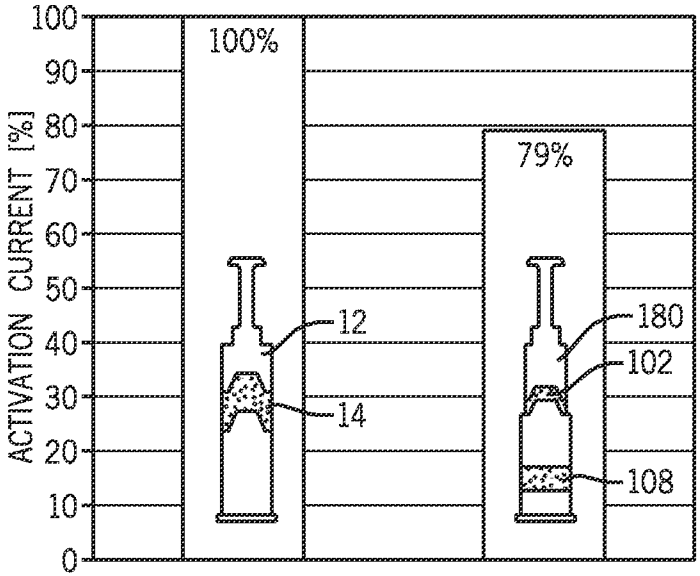
FIGS. 11 and 12 show graphical comparisons of a single gap actuator compared to a two gap actuator, and indicate an efficiency improvement with the two gap actuator.
Figure 12:
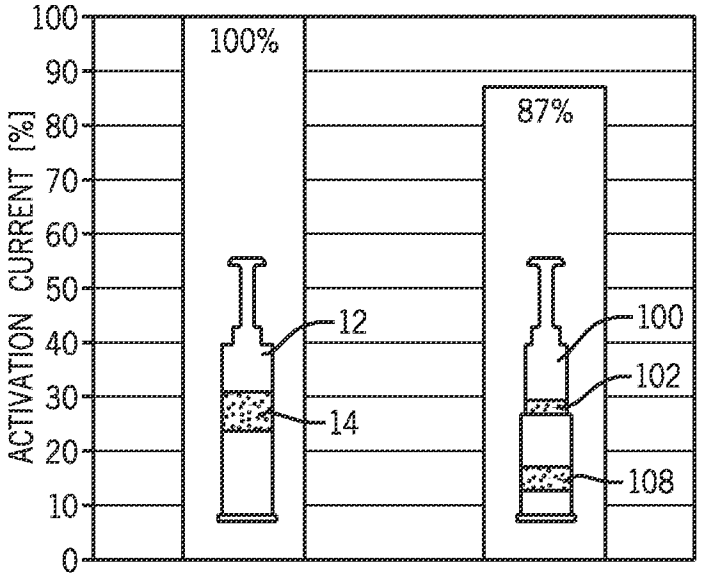

FIGS. 11 and 12 show graphical comparisons of a single gap actuator 12 compared to a two gap actuator 100 and 180. The graphs indicate an efficiency improvement with the two gap actuator. As can be seen, with all other parameters being equal, the activation current required for the single gap actuator 12 is equal to 100 percent, which has been set as the reference. In comparison, in FIG. 11, the two gap actuator 100 with generally flat pole faces requires only 87 percent of the activation current, and in FIG. 12, the two gap actuator 180 with the first actuator gap 102 having generally frustoconical pole faces requires only 79 percent of the activation current. Each two gap actuator 100 and 180 shows a significant efficiency improvement.

FIG. 13 shows a graphical comparison of the magnetic force F for a given current between a single gap actuator and a two gap actuator. The graph shows the qualitative traces of the magnetic force over armature travel. Notably, the starting point (position one) of the two gap actuator 100 is a magnitude higher shown as $\Delta F_{init}$ than the starting point of the one gap actuator 12. This improved increase on the magnetic force on the armatures 104 and 106 results from the shorter first actuator gap 102 and enables a desirable early release of the trip mechanism.

Figure 14:
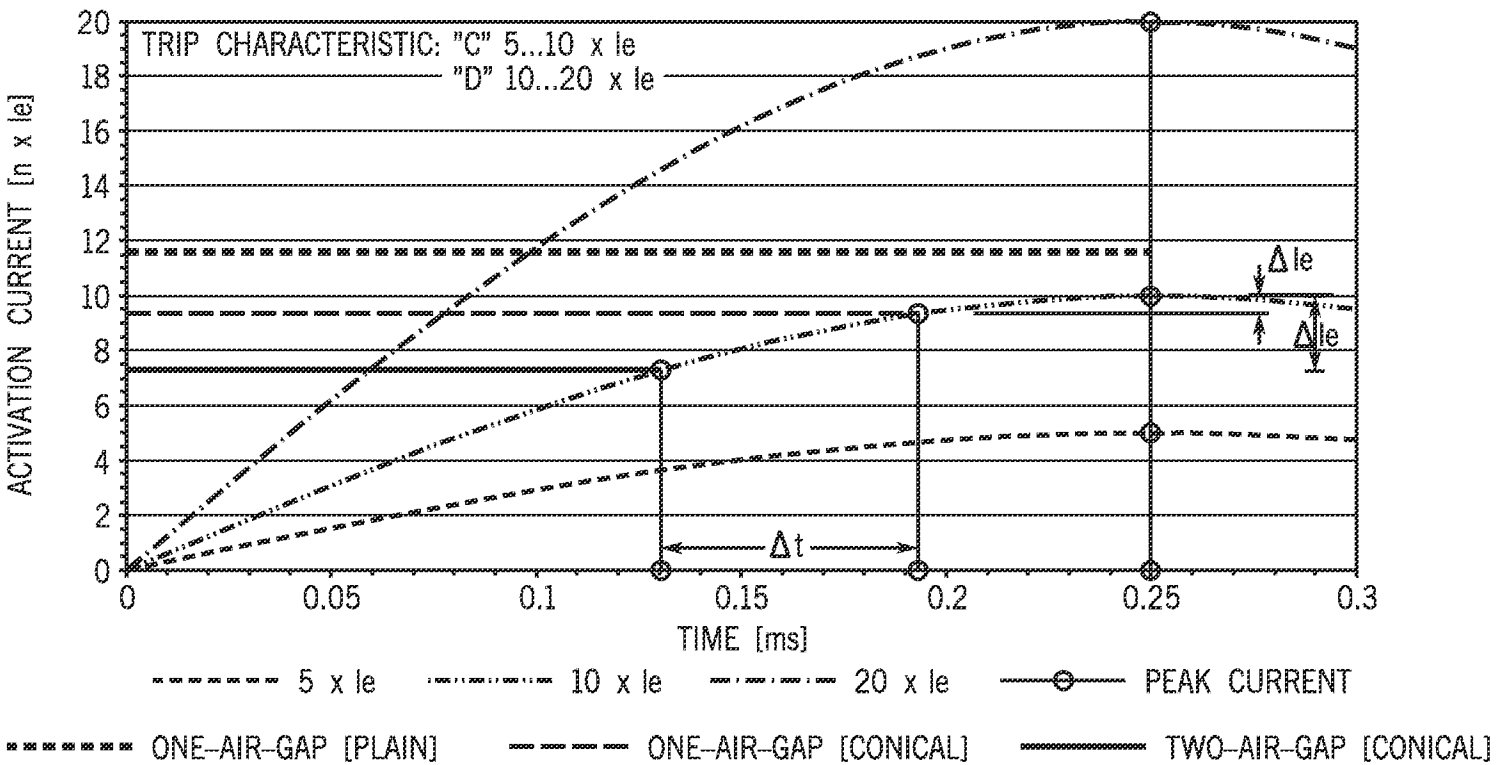
FIG. 14 shows the gain of activation current (n times rated current) for a two gap actuator compared to one gap actuators.

FIG. 14 graphically shows the gain of activation current (n times rated current). Standard one gap actuators for motor protection circuit breakers are typically designed to trip at approximately 12 times rated current. Some line protection circuit breaker standards require so called trip characteristics "C" or "D" for example, which operate within a range where "C" is 5 to 10 times rated current, and "D" is 10 to 20 times rated current. These operational limits are indicated in FIG. 14. In one example, to meet the "C" characteristics, standard one gap actuators must increase the volume of the trip unit considerably, which creates inefficiencies, and increases cost and size.

In comparison, for example, using a two gap actuator with frustoconical pole faces in the first armature gap 102 (see FIG. 5) enables the unit to trip at approximately 6.7 times rated current instead of approximately 12 times rated current for the one gap actuator. In this novel configuration, the trip time is shortened by approximately 30 percent.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Finally, it is expressly contemplated that any of the processes or steps described herein may be combined, eliminated, or reordered. Accordingly, this description is meant to be taken only by way of example, and not to otherwise limit the scope of this invention.

We claim:

1. A magnetic actuator for opening a contact to interrupt a flow of current, the actuator comprising:

a first armature and a second armature, the first armature and the second armature spaced apart by a first gap while in a reset position;

the second armature and a core spaced apart by a second gap while in the reset position;

a plunger, the plunger having a plunger first end and a plunger second end, the plunger extending through the second armature, the first armature to push the plunger through the second armature until the first gap closes;

in a tripped position, the first gap between the first armature and the second armature is closed, and with the first gap closed, the second gap between the second armature and the core is closed, and the contact is open; and a plunger gap between the plunger second end and a push rod, the plunger gap to close before the first gap closes and before the second gap closes.

2. The actuator according to claim 1:

wherein the first gap is larger than the second gap.

3. The actuator according to claim 1:

wherein the plunger second end contacts a push rod before the first gap closes.

4. The actuator according to claim 1:

wherein the plunger is a non-magnetic plunger.

5. The actuator according to claim 1:

wherein the plunger slidably extends through the second armature.

6. A magnetic actuator for use in a circuit interruption device, the magnetic actuator comprising:

a first armature having a first armature pole face;

a second armature having a first pole face and a second pole face;

a first air gap bounded by at least the first armature pole face and the second armature first pole face while in a reset position;

a plunger extending through the second armature;

a core having a core pole face;

a second air gap bounded by at least the second armature second pole face and the core pole face while in the reset position;

the first armature, the second armature, the plunger, and the core housed within a coil former;

the first air gap and the second air gap are closed when the magnetic actuator interrupts the circuit; and a rim on the coil former, the rim to stop the movement of the second armature toward the first armature and maintain the first air gap while fully in the reset position.

7. The actuator according to claim 6:

wherein the first armature pole face is flat.

8. The actuator according to claim 6:

wherein the first armature pole face is frustoconical.

9. The actuator according to claim 6:

wherein one of the first gap and the second gap has a frustoconical shape, and the other of the first gap and the second gap has a flat shape.

10. The actuator according to claim 6:

wherein the first armature, the second armature, and the plunger are slidabley positioned within the coil former.

11. The actuator according to claim 10:

wherein the core is also positioned within the coil former and a cover maintains the position of the core.

12. A circuit breaker for interrupting a flow of current upon a sensing of an overcurrent condition, the circuit breaker comprising:

a housing;

a trip unit within the housing, the trip unit including a magnetic actuator, the magnetic actuator including a first armature spaced apart from a second armature to form a first air gap, and a core spaced apart from the second armature to form a second air gap;

the first armature to travel toward the second armature to close the first air gap, and with the first air gap closed, the first armature and the second armature to travel together toward the core to close the second air gap and the flow of current is interrupted; and a first rim on the coil former, the first rim to stop the movement of the first armature away from the second armature, and a second rim on the coil former, the second rim to stop the movement of the second armature toward the first armature and maintain the first air gap while in a fully reset position.

13. The circuit breaker according to claim 12:

wherein a push rod opens a contact before the second air gap closes.

14. The circuit breaker according to claim 12:

wherein the first armature contacts a plunger before the first air gap is closed, and the plunger contacts a push rod before the first gap is closed.

15. The circuit breaker according to claim 14:

wherein a spring biases the plunger away from the push rod.

16. A magnetic actuator for opening a contact to interrupt a flow of current, the magnetic actuator comprising:

a first armature and a second armature, the first armature and the second armature spaced apart by a first gap while in a reset position, the first armature to push a plunger through the second armature until the first gap closes;

the second armature and a core spaced apart by a second gap while in the reset position;

in a tripped position, the first gap between the first armature and the second armature is closed, the second gap between the second armature and the core is closed, and the contact is open; and a plunger gap between the plunger and a push rod, the plunger gap to close before the first gap closes and before the second gap closes.

* * * * *